United States Patent [19]

Gaudard

[11] 4,032,139

[45] June 28, 1977

[54] PROCESS FOR EXTENDING THE SEASONAL USEFUL LIFE OF SKI TRAILS AND SKI TRAILS PRODUCED THEREBY

[75] Inventor: Yves Gaudard, Lyon, France

[73] Assignee: Rhone-Poulenc-Textile, Paris, France

[22] Filed: Apr. 26, 1972

[21] Appl. No.: 247,638

[30] Foreign Application Priority Data

May 3, 1971 France ..... 71.16118

[52] U.S. Cl. ..... 272/56.5 SS

[51] Int. Cl.[2] ..... A63B 69/18; A63G 21/02

[58] Field of Search ..... 272/56.5 SS, 56.5 R; 161/150, 170

[56] References Cited

UNITED STATES PATENTS

| | | | |
|---|---|---|---|
| 3,106,507 | 10/1963 | Richmond | 161/150 X |
| 3,233,893 | 2/1966 | Meyer | 272/56.5 SS |
| 3,400,643 | 9/1968 | Holley | 272/70 |
| 3,547,749 | 12/1970 | White et al. | 272/56.5 SS UX |
| 3,691,004 | 9/1972 | Werner et al. | 47/56 |

FOREIGN PATENTS OR APPLICATIONS

| | | | |
|---|---|---|---|
| 1,029,790 | 5/1966 | United Kingdom | 161/150 |

*Primary Examiner*—Richard C. Pinkham
*Assistant Examiner*—Arnold W. Kramer
*Attorney, Agent, or Firm*—Sherman & Shalloway

[57] ABSTRACT

A process for extending the seasonal useful life of ski trails including covering a sloping terrain with an elongate non-woven fabric prior to the first snow fall such that melting of the snow collected on the fabric is retarded, and a ski trail produced in accordance with the above process.

3 Claims, 3 Drawing Figures

PROCESS FOR EXTENDING THE SEASONAL USEFUL LIFE OF SKI TRAILS AND SKI TRAILS PRODUCED THEREBY

BACKGROUND OF THE INVENTION

1. Field of the Invention:

The present invention pertains to ski trails and, more particularly, to a process for extending the period during which sloping terrains can be utilized for skiing and ski trails produced by such process.

2. Discussion of the Prior Art:

Winter sporting events such as skiing must normally be scheduled conditionally dependent upon the weather in that a sufficient snow fall may be required in order for the ski trails to have an adequate layer or base of snow for skiing. If the snow covering a sloping terrain used for skiing is insufficient, rough spots in the ground as well as leaves, sticks, rocks and other protrusions will extend above the upper most surface of the snow thereby presenting hazardous conditions for the skiers. Furthermore, with a light snow fall stretches or large areas of terrain including ground, grass and/or rocks will provide even more sever hazards to the skiers. Of course, with a light snow fall and the attendent hazards mentioned above, the risks of falls are greatly increased and the severity of injuries sustained from such falls is also increased. Furthermore, the sliding movement over rigid surfaces such as bare ground or grass and obstacles such as rocks, sticks and leaves is detrimental to skis and tends to scar and gouge the sliding surfaces of the skis.

In order to overcome the problems concomitant with lack of sufficient snow for skiing, it has been proposed to cover the trail with artificial snow; however, this solution is extremely expensive in that machines for producing artificial snow are quite costly. Another solution proposed to overcome the problems of a lack of snow is the use of artificial ski trails made of synthetic materials having extremely good sliding qualities and resistance to wear; however, the use of such artificial trails does not provide the same sensation and effects as skiing on snow and are not well accepted by skiers. Another disadvantage of the use of artificial ski trails is that injuries from falls are more sever since sliding on the synthetic material causes skin burns and has a tendency to tear apparel worn by the skier; and, additionally, artificial ski trails are not aesthetically pleasing and appear out of place at a winter sports locale.

SUMMARY OF THE INVENTION

Accordingly, it is an object of the present invention to overcome the problems resulting from a light snow fall by extending the period prior to melting of fallen snow to, accordingly, extend the seasonal period during which a sloping terrain may be utilized for skiing.

The invention is generally characterized in a process for extending the period during which sloping terrains can be utilized for skiing including the step of covering the sloping terrain with an elongate fabric support material prior to a snow fall such that a layer of snow collects on the fabric support material, the length of the fabric support material running along the sloping direction of the terrain to define a ski trail. The present invention is further generally characterized in a ski trail including a sloping terrain and a layer of snow and having the improvement of an elongate strip non-woven fabric disposed between the sloping terrain and the layer of snow with the length of the strip aligned with the direction of the slope whereby the layer of snow is thermally insulated from the sloping terrain to retard melting of the snow and extend the seasonal period during which the sloping trail can be utilized for skiing.

Another object of the present invention is to dispose a strip of fabric support material on a sloping terrain prior to the first snow fall of the winter season such that a layer of snow will collect on the fabric support material to provide a ski surface having an extended life.

A further object of the present invention is to provide a process for extending the life of a ski trail by unrolling one or more strips of elongate fabric in the direction of slope of a sloping trail prior to the first snow fall of the season such that the elongate fabric provides thermal insulation between the layer of snow collected during the winter season and the sloping terrain whereby melting of the snow is retarded. If two or more strips of fabric are utilized to form the ski trail, adjacent strips may be joined by suitable fastening means such as sewing, gluing, fusing or simply by placing the strips with a slightly overlaping of the longitudinal edges thereof.

The present invention has yet an additional object in that a ski trail includes a layer of spun-bonded, non-woven material disposed between a sloping terrain and a layer of snow in order to extend the period during which the snow exists to provide a ski trail.

Some of the advantages of the present invention over the prior art are that the length of the ski season is increased due primarily to the snow on the fabric melting much slower than snow directly resting on the ground, geographical areas receiving only marginal snow fall may utilize sloping terrains for ski trails for an extended skiing season, an extremely thin layer of snow in the range of tens of centimeters may be utilized for skiing without danger since the layer of snow is uniform along the strip of fabric and since any areas in which snow has been inadvertently removed will expose only the fabric which will not damage the skis and do not present a hazardous obstacle for skiers.

Other objects and advantages of the present invention will become apparent from the following description of the preferred embodiment taken in conjunction with the accompanying drawings.

DESCRIPTION OF THE PREFERRED EMBODIMENT

Figure 1:
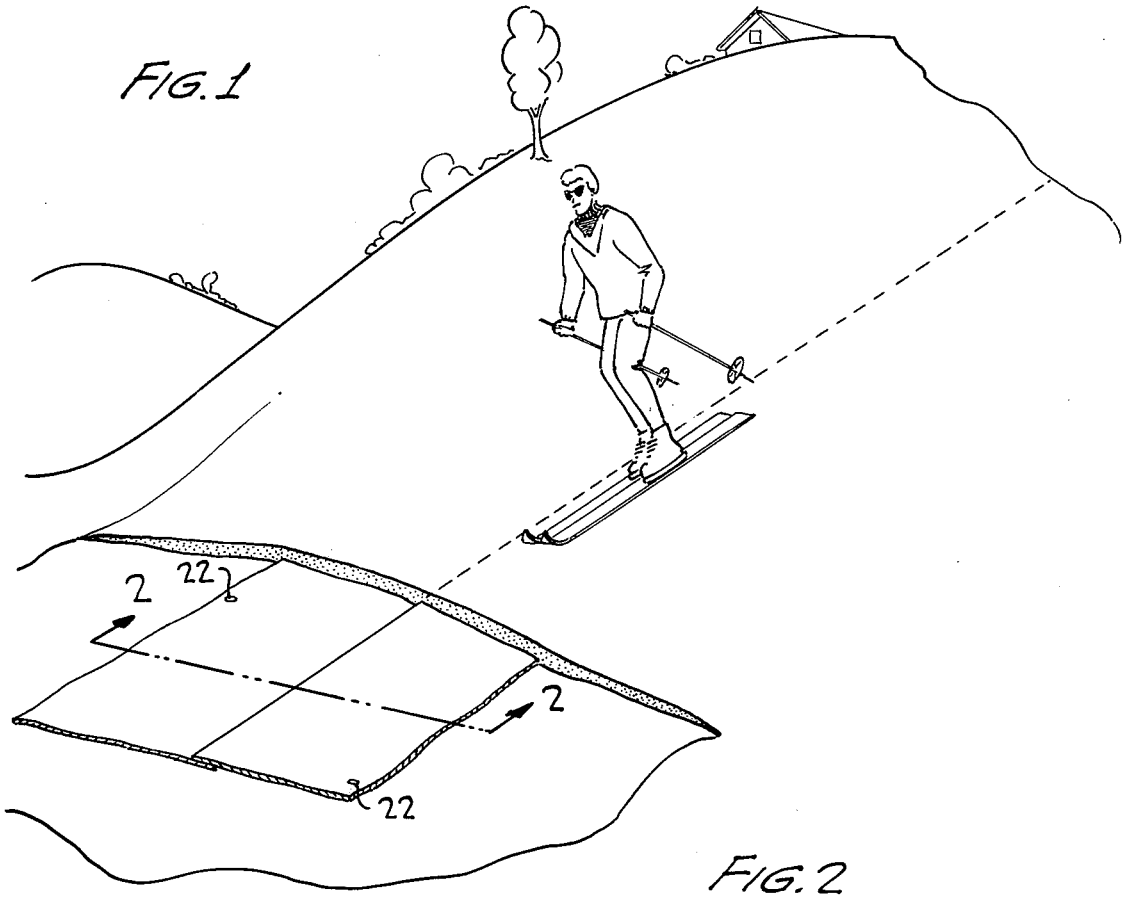
FIG. 1 is a perspective view of a ski trail formed in accordance with the present invention.
Figure 2:
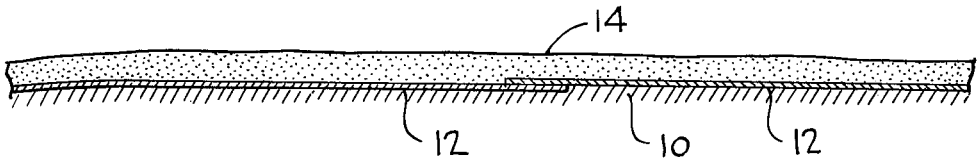
FIG. 2 is a section of the ski trail of FIG. 1 taken along line 2—2.

The ski trail of the present invention, as illustrated in FIG. 1, is formed on a sloping terrain indicated generally at 10 on which is placed one or more elongate strips of fabric support material 12, the length or longitudinal dimension of the strips of fabric support material being aligned and running along the sloping direction of the terrain. As illustrted in FIG. 2, the strips of fabric support material 12 are disposed on the bare terrain 10 prior to the first snow fall of the season such that a layer of snow 14 collects on the strips of fabric support material, the depth of the layer of snow being dependent upon the snow fall.

Figure 3:
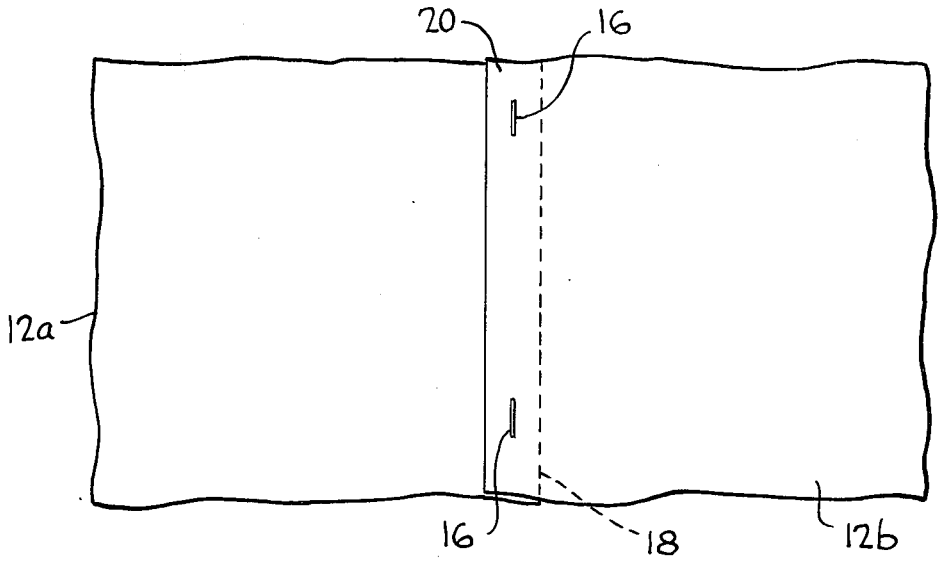
FIG. 3 is a broken plan view illustrating the fastening of adjacent strips of fabric in accordance with the present invention.

If a plurality of strips 12 of fabric support material are disposed on the sloping terrain 10, the longitudinal edges of the strips of material 12 should be positioned such that no gaps remain therebetween. The longitudinal edges of adjacent strips may be fastened together in any suitable manner such as by sewing, gluing, heat fastening in the manner of fusing, or simply by laying the longitudinal edges in overlapping fashion. As illustrated in FIG. 3, fastening elements, such as sewing stitches 16, are utilized to secure a strip 12*a* having a marginal longitudinal edge 18 to a strip 12*b* having a marginal longitudinal edge 20. The strips are positioned by first unrolling a reel having a strip 12*a* wound therearound from a position near the top of the ski trail down the terrain 10 in the sloping direction thereof. After strip 12*a* has been properly positioned on the sloping terrain, a reel having strip 12*b* sound therearound is unrolled down the sloping terrain with marginal longitudinal edge 20 overlapping marginal longitudinal edge 18 of strip 12*b*. Once the strips are positioned in overlapping relation they are secured to each other at the overlapping marginal longitudinal edges such as by the spaced stitches 16 or by any other suitable means. Advantageously, heat may be utilized to form a bonded or fused fastening means consisting of the fibers of the strips. The longitudinal spacing between fastening points is determined by the strength required to prevent slipping of the strips relative to each other and prevent gaps from being formed between the edges of the strips.

The proper positioning of adjacent strips of fabric support material is important to permit uniform melting of the snow on the ski trail in that, if a gap between the longitudinal edges exists, the snow at the gap will melt before the layer of snow on the strip of fabric material thereby creating a hazardous obstacle for the skier. If desired, the strips of fabric material can be secured to the ground to prevent displacement, for example by the use of stakes or concrete or iron pins 22, as shown in FIG. 1, taking care that the stakes or pins are positioned so as not to protrude to form potentially dangerous areas.

The fabric support material 12 is advantageously made of a material with a base of natural or chemical yarns or fibers in the form of a fabric such as a knit or, preferably, a non-woven material made of continuous filaments. Non-woven fabrics formed of continuous filaments randomly spaced throughout the fabric are known, such products being often referred to by the generic term "spun-bonded"; and, accordingly, this term will be utilized hereinafter to simplify the description of the fabric support material. Manufacture of spun-bonded fabrics require basically extruding a molten or even dissolved organic polymer through a spinneret, orienting the extruded continuous filaments by drawing a bundle through one or more jets of fluid such as compressed air and delivering the bundle of continuous filaments to a moving belt having its speed and direction regulated to form a non-woven, substantially regular sheet having a desired thickness. In practice, the sheet thus formed is subjected to a calibrating or calendering step, preferably under heat treatment, such that the filaments are bonded to one another at least on the surface thereby increasing the cohesion of the sheets. Normally only a slight calibrating is required.

Spun-bonded sheets of material for use with the present invention are preferably needled in order to give the sheet a cohesion and fluffy appearance facilitating attachment of the snow crystals to the surface of the fabric support material.

Specific fiber forming polymers useful in producing fabric support material for use in accordance with the present invention include the polyesters, i.e. polymers derived from the reaction of at least one glycol, e.g. ethylene glycol, propylene glycol, diethylene glycol, etc. with at least one dibasic acid, e.g. adipic acid, terephthalate acid, isoterephthalate acid, etc., such polyesters being exemplified by polyethylene glycol terephthalate; acrylonitrile and modified acrylonitrile polymers such as a homopolymer of acrylonitrile; linear polyamides having an amide group as an integral part of the polymer chain, including nylon 6 prepared by the polycondensation of caprolactam, nylon66, hexamethylenediamine, nylon 610, hexamethylenediamine, nylon 11 prepared from 11-aminoundecanoic acid, etc., polyolefins such as polyethylene, polypropylene and copolymers thereof as well as vinyl polymers such as polyvinyl chloride.

The above mentioned polymers advantageously empolyed in accordance with the present invention may have incorporated therein one or more ultraviolet light absorbing agents to prevent degradation of the base polymer. In this regard, the ultraviolet light absorbing agents employed in accordance with the present invention are those chemical agents which absorb or screen out radiation beyond the violet end of the spectrum of visible radiation and include, for example, benzophenones, benzotriazoles, substituted acrylonitriles, and salicylic acid derivatives as well as nickel complexes.

If desired, the strips of fabric support material can be provided with textile reinforcement, such as by layers of filaments or fibers positioned either in parallel skew or random orientation, grill fabrics, etc., with a charge or adjuvant material such as a self-lubricating resin to improve the sliding characteristics of the fabric support material, ultraviolet absorbing agents, etc. Preferably, the fabric support material is in the form of a spun-bonded, non-woven sheet of continuous filaments of a synthetic material that degrades little when subjected to ultraviolet rays and resists wear.

The strips of fabric support material should have sufficient density or weight so as not to be dragged or slid along the sloping terrain by the forces generated by skiers and so as not to be torn by the sliding of skis over exposed areas where the layer of snow has melted or been otherwise removed. The weight of the strips of the fabric support material is preferably within the range of from 50 to 600 grams per square meter.

The present invention will be more fully illustrated by way of the following specific example which is for the purpose of illustration only and is to be in no way considered as limiting.

EXAMPLE 1

At a skiing area located at 800 meter altitude, there was unrolled, before the first snow fall, along a stony trail having a slope of about 20%, at the exit of a bend and on the outside edge of the trail, a strip of fabric support material 5 meters wide, 50 meters long and weighing 300 g per square meter, of a needled, spun-bonded, non-woven fabric made of polyethylend terephthalate filaments with a count of 8 dtex (7.2 den). At the end of three months, after passage of several thousand skiers, skiing was still possible on the snow collected on the strip, whereas outside the strip the trail was impassable. It was also found during the three months that, after each snow fall, the layer of snow collected on the strip remained much longer than the snow which fell on the ground.

The process of the present invention and the ski trails formed in accordance therewith provide the great advantage of retarding the melting of the snow collected thereon after snow laying directly on the ground has melted thereby prolonging the skiing season at locations where the snow fall is limited. Furthermore, by utilizing a non-woven fabric in accordance with the preferred embodiment of the present invention, thermal insulative properties of the fabric are greatly increased as compared with woven fabrics while preventing permanent damage to the terrain as is normally caused by artificial ski trails. That is, the strips of fabric support material as utilized in accordance with the present invention may be easily removed from the terrain after the prolonged skiing season to permit normal growth of vegetation.

Inasmuch as the present invention is subject to many variations, modifications and changes in detail, it is intended that all matter described above or shown in the accompanying drawings be interpreted as illustrative and not in a limiting sense.

What is claimed is:

1. A process for extending the period over which fallen natural snow will remain on sloping terrain and during which said sloping terrain can be utilized for skiing comprising the step of covering a sloping terrain with an elongate non-woven fabric support material formed of synthetic continuous filaments wherein said non-woven fabric is a needled, spun-bonded fabric of polyethylene terephthalate prior to a snow fall such that a layer of snow collects on the non-woven fabric support material, the length of the non-woven fabric support material running along the sloping direction of the terrain to define a ski trail to thereby extend the period prior to melting of fallen natural snow, and accordingly, extend the seasonal period during which a sloping terrain may be utilized for skiing with natural snow.

2. The method as recited in claim 1 wherein said non-woven fabric has a weight within the range of from 50 to 600 grams per square meter.

3. The method as recited in claim 1 wherein said covering step includes unrolling a plurality of elongate strips of non-woven fabric support material formed of said synthetic continuous filaments along the sloping direction of the terrain with the longitudinal edges of the strips in overlapping relation.

* * * * *